United States Patent [19]

Nakamura

[11] Patent Number: 5,048,718

[45] Date of Patent: Sep. 17, 1991

[54] DISPENSER-CONTAINER, AND A PROCESS FOR MANUFACTURING THE SAME AND AN APPARATUS THEREFOR

[75] Inventor: Kenji Nakamura, Osaka, Japan

[73] Assignee: Kennak U.S.A. Inc.

[21] Appl. No.: 433,514

[22] Filed: Nov. 8, 1989

[30] Foreign Application Priority Data

Nov. 9, 1988 [JP] Japan ..... 63-283500
Feb. 17, 1989 [JP] Japan ..... 1-38549

[51] Int. Cl.[5] ..... B65H 1/00

[52] U.S. Cl. ..... 221/35; 206/233; 221/63

[58] Field of Search ..... 221/34, 35, 61, 62, 221/63, 64, 65, 47, 48; 206/205, 223, 233, 494, 812; 383/38–40

[56] References Cited

U.S. PATENT DOCUMENTS

| | | | |
|---|---|---|---|
| 2,917,164 | 12/1959 | Kehr | 383/40 X |
| 2,952,398 | 7/1960 | Gerard | 383/39 X |
| 4,651,874 | 3/1987 | Nakamura | 206/205 |
| 4,840,270 | 6/1989 | Caputo et al. | 206/205 |

FOREIGN PATENT DOCUMENTS

| | | | |
|---|---|---|---|
| 33125 | 12/1907 | Fed. Rep. of Germany | 383/40 |
| 308739 | 12/1989 | Japan | 383/38 |

*Primary Examiner*—H. Grant Skaggs
*Assistant Examiner*—Keith L. Dixon
*Attorney, Agent, or Firm*—Burgess, Ryan & Wayne

[57] ABSTRACT

A dispenser-container comprises a container body provided with two containing spaces, containing wet contents and dry contents, respectively. The container body is a bag constituted by a first flexible sheet made of a liquid impervious material and a second flexible sheet made of a liquid impervious material. The first sheet constitutes a bag of a pillow type, longitudinal edges of the first sheet overlap each other and are at most slightly sealed with each other in such an extent that they can be manually separated to form an opening for dispensing the dry contents. The second sheet is fixed to the first sheet at entire peripheries thereof and is located outside or inside the pillow type bag. The first sheet or the second sheet has an opening or a weakened line for forming the opening, to permit dispensing of the wet contents, at a position forming a surface of the container body and being opposite to the overlapping longitudinal edges of the first sheet, and has a flexible flap for resealably covering the opening for dispensing the wet contents. The wet contents is contained in one of the containing spaces, formed between the first sheet and the second sheet and provided with the releasable flap.

8 Claims, 12 Drawing Sheets

DISPENSER-CONTAINER, AND A PROCESS FOR MANUFACTURING THE SAME AND AN APPARATUS THEREFOR

BACKGROUND OF THE INVENTION

1. Field of the Invention

The present invention relates to a portable dispenser-container containing contents in a wet condition and contents in a dry condition, such as wet tissues and dry tissues. More specifically, the present invention relates to a portable dispenser-container, from which the wet tissues and the dry tissues contained therein can be individually dispensed one by one, and especially, it can be repeatedly opened and resealed for wet tissues required to be hermetically sealed.

2. Description of the Prior Art

Recently, wet tissues, i.e., fibrous materials impregnated with cleaning solution such as alcohol, have been utilized widely for cleaning dirt on hands or other body portions. Such wet tissues packed in a cylindrical container are used at home or shops, and wet tissues contained in a small dispenser-container are sold for portable use and are widely used.

Although wet tissues are convenient for cleaning skin or make up, their usage has been limited since they are in a wet condition. In other words, in some cases, they cannot be used in place of dry tissues. Accordingly, it is necessary for users to take dry tissues as well as wet tissues outdoors.

Either one of wet tissues and dry tissues may be often left behind, if a user wants to have both a small dispenser-container of wet tissues and a small dispenser-container of dry tissues. Accordingly, a portable pack wherein wet tissues and dry tissues are combined is convenient.

An example of such a portable pack is disclosed in Japanese Utility Model Publication No. Sho 57-60399. In the pack disclosed in this publication, wet tissues and tissue paper are contained in a bag-like pack made of a water impervious resin film in such a manner that both the tissues are laterally in parallel, and the central portion of the pack between the wet tissue and the tissue paper and the peripheries of the pack are heat sealed. The pack is intended to be folded at the heat sealed central portion.

Since the portable pack disclosed in the above-described Japanese Utility Model Publication No. Sho 57-60399 has a construction as described above, the industrial manufacture of the pack is difficult.

More specifically, when the portable pack disclosed in Japanese Utility Model Publication No. Sho 57-60399 is intended to be manufactured, wet tissues and tissue paper have to be laid on a lower resin film while they are laterally in parallel, and an upper resin film provided with dispensing openings for the wet tissues and the tissue paper is supplied onto the laid wet tissues and tissue paper, and then the central portion of between the wet tissue and the tissue paper and the peripheries of the pack are heat sealed to form a bag.

However, in such a manufacturing process, when the wet tissues and tissue paper are laid on a lower resin film while they are laterally in parallel, liquid which has impregnated the wet tissues may leak out or flow out, and the adjacent tissue paper may be wetted and may be deteriorated.

In addition, portions to be heat sealed on the resin film may also be wetted, and the heat sealing may be difficult.

Although the peripheries of the pack can be heat sealed with relative ease, heat sealing at the central portion between the wet tissues and the tissue paper can not be done well unless the positions of the wet tissues and the tissue paper are precise. Accordingly, the wet tissues and the tissue paper must be precisely supplied to the predetermined positions on the lower film, and the displacement of the laid materials must be prevented while they are transferred to the sealing station. These require very complicated control and adjustment, and in actual fact, satisfaction of these requirements is very difficult. Thus, continuous manufacture of such packs is practically impossible.

In an alternative process for manufacturing the above-described packs, a bag with one open side is prepared by sealing three peripheries of the pack and the central portion, and after the wet tissues and the tissue paper are inserted into the bag through the open side, the open side is heat sealed to form a portable pack.

However, it is difficult to automatically insert tissues, especially wet tissues, into the bag, and accordingly, continuous manufacture of the packs is impossible. Accordingly, the cost of the above-described pack is expensive.

In addition, the portable pack disclosed in the above-described Japanese Utility Model Publication No. Sho 57-60399 is a four-sided seal pack, wherein the peripheries of the three sheets are sealed together, the pack has hard peripheries. Accordingly, it is not easy for a user to handle the pack since the hard portions in the pack may hit the user's hand. Further, the size of the pack may be voluminous by the size of the sealed peripheries compared with the sum of the sizes of the contents and the necessary tolerance.

Further, the portable pack disclosed in the above-described Japanese Utility Model Publication No. Sho 57-60399 is folded at the heat sealed central portion when it is carried. However the pack as a whole is bulky because the wet tissues, the tissue paper and the four thick films are stacked and because the folded portion has a tendency to open. Thus, a compact dispenser-container for portable use is required.

The present applicant previously proposed in Japanese Patent Publication No. Sho 58-41842 a dispenser-container, wherein three sheets are used, two of which are used for the bag and the other one of which is used for a partition, and are superposed, and the four peripheries of the sheets are sealed while the dry contents and wet contents, sandwiching the partition therebetween, are inserted into spaces between the sheets.

Since the portable pack disclosed in the above-described Japanese Patent Publication No. Sho 58-41842 is a four-sided seal pack, wherein the peripheries of the three sheets are sealed together, the pack has hard peripheries. Accordingly, it is not easy for a user to handle the pack since the hard portions in the pack may hit the user's hand. Further, the size of the pack may be voluminous by the size of the sealed peripheries compared with the sum of sizes of the contents and the necessary tolerance.

When the dispenser-container disclosed in Japanese Patent Publication No. Sho 58-41842 is manufactured, contents in a dry condition are disposed on a sheet-like material, and then, a sheet-like material for partition is laid over the contents, and thereafter, contents in a wet condition are disposed on the sheet-like material for partition. In such a stacked condition, the peripheries of the three sheets are heat sealed. Since the two kinds of contents are stacked via a partition or since the three sheets are simultaneously heat sealed while two kinds of contents are sandwiched therebetween as described above, adjustment for continuous manufacture is relatively complicated. Especially, when the thickness of the contents is large, the stacked contents may be displace. Accordingly, in this case, it is necessary to enlarge the sizes of the sheets relative to the contents contained in the pack. Therefore, it is difficult to obtain compact dispenser-containers.

Besides the present applicant proposed in Japanese Patent Application Laid-open No. Sho. 61-203305 a method of producing a dispenser-container containing two kinds of contents, wherein first contents, for example, contents containing wet materials, are contained in an inner container provided with a dispensing opening and a flexible flap, an opening is formed in a sheet to be an outer bag, the position of the opening formed in the sheet for the outer bag and the position of the flap of the inner bag coincide while the inner container and second contents are stacked, and the stacked inner container and the second contents are wrapped by the sheet for the outer bag and the outer bag is formed.

According to the method for producing dispenser-containers disclosed in Japanese Patent Application Laid-open No. Sho. 61-203305, a process is necessary, in which process prepared are the first contents contained in the inner container provided with an opening and a flexible flap for releasably covering the opening. After this process, it is necessary for the inner container hermetically containing the first contents and the second contents to be wrapped by a sheet for the outer bag. Thus, the manufacturing process may be lengthy and productivity is not high.

Further, according to the method, the position of the opening of the sheet for the outer bag and the position of the flap of the inner bag have to coincide with each other while the inner bag and the second contents are stacked. The adjustment in the manufacturing operation is relatively complicated. Further, since the inner bag itself constitutes a perfect resealable dispenser-container, the finally obtained dispenser-container containing two kinds of contents may be bulky, because of the longitudinal seal when the inner bag is of a pillow type, or because of the sealed peripheries when the inner bag is a four-sided seal pack.

OBJECTS OF THE INVENTION

The present invention was achieved taking into consideration the above-described problems inherent to the prior art and characteristics required for a dispenser-container for containing wet contents and dry contents.

An object of the present invention is to provide a dispenser-container containing wet and dry contents, by which the above-described problems inherent in the prior art can be obviated.

Another object of the present invention is to provide a dispenser-container containing wet and dry contents, which is inexpensive, compact and easy to handle for a portable use.

A still other object of the present invention is to provide a dispenser-container containing wet and dry contents, which is simple in construction and compact and which can be manufactured easily at a low cost.

A further object of the present invention is to provide a process for continuously manufacturing such a dispenser-container.

A still further object of the present invention is to provide an apparatus for performing the process for continuously manufacturing a dispenser-container of the present invention.

SUMMARY OF THE INVENTION

According to the present invention, the above-described objects are achieved by a dispenser-container comprising a container body provided with two containing spaces, one of the containing spaces containing contents in a wet condition and the other of the containing spaces containing contents in a dry condition, characterized in that:

the container body is a bag constituted by a first flexible sheet made of a liquid impervious material and a second flexible sheet made of a liquid impervious material;

the first sheet constitutes a bag of a pillow type, longitudinal edges of the first sheet overlap each other and are at most slightly sealed with each other in such an extent that they can be manually separated, whereby an opening for dispensing the contents in a dry condition is formed;

the second sheet is fixed to the first sheet at entire peripheries thereof and is located at one of the outside and inside of the bag of a pillow type;

one of the first sheet and second sheet has one of an opening and a weakened line for forming the opening, to permit dispensing of the contents in a wet condition therethrough, at a position forming a surface of the container body and being opposite to the overlapping longitudinal edges of the first sheet, and has a flexible flap for resealably covering the opening for dispensing the contents in a wet condition; and the contents in a wet condition are contained in one of the containing spaces formed between the first sheet and the second sheet and provided with the resealable flap.

It is preferred that the longitudinal edges of the containing space for tissues in a dry condition are slightly sealed with each other in such an extent that they can be manually separated. Because of this construction, a user is assured by manually separating the longitudinal edges that nobody has taken the contents out of the containing space before the user uses the same.

However, the longitudinal edges of the first sheet overlapping each other may not be sealed at all with each other.

In place of the above-described arrangement of the opening, which is formed by not sealing the longitudinal edges of the first sheet, for dispensing the contents in a dry condition, in the dispenser-container according to the present invention, while the overlapping longitudinal edges of the first sheet are sealed, a weakened line such as a perforated line may be formed on the surface of the first sheet, where the overlapping seal is formed, so as to form an opening for dispensing the contents in a dry condition.

The process for manufacturing a dispenser-container provided with two containing spaces according to the present invention is characterized by:

feeding a liquid impervious continuous sheet having weakened lines for forming openings at a predetermined distance, and having flexible flaps for resealably covering the openings;

feeding another liquid impervious continuous sheet in such a manner that it overlays with the sheet having the flexible flaps;

supplying contents in a wet condition between the sheets before they completely overlay with each other;

supplying contents in a dry condition in such manner that they overlay with the contents in a wet condition sandwiching the other sheet therebetween;

fixing both longitudinal edges of one of the sheets to the other sheet;

wrapping the contents in a dry condition by the other sheet along a longitudinal direction;

transversely sealing both the sheets; and transversely cutting the sheets.

More specifically, the first process for manufacturing a dispenser-container provided with two containing spaces according to the present invention is characterized by:

feeding a first continuous sheet of a liquid impervious material having weakened lines for forming openings therein at a predetermined distance, and having flexible flaps for resealably covering the openings disposed thereon;

disposing contents in a wet condition at positions corresponding to the portions to be the openings on a surface of the first sheet opposite to that provided with the flaps;

feeding a second continuous sheet of a liquid impervious material over the contents in a wet condition;

fixing both longitudinal edges of the second sheet to the first sheet;

disposing contents in a dry condition at positions corresponding to the contents in a wet condition sandwiching the second sheet therebetween;

wrapping the contents in a wet condition, the second sheet and the contents in a dry condition by the first sheet to overlap longitudinal edges of the first sheet;

transversely sealing transverse openings of the first and second sheets; and transversely cutting the first and second sheets.

In the second definite process for manufacturing a dispenser-container provided with two containing spaces according to the present invention, the first sheet is overlaid on the contents in a wet condition after the contents in a wet condition are disposed on the second sheet, in place of overlaying the second sheet on the contents in a wet condition after the contents in a wet condition are disposed on the first sheet in the first process. According to this process, the contents in a dry condition may be supplied from beneath and may be wrapped by the first sheet from above.

According to the first and second process described above, a dispenser-container is obtained, wherein the first sheet which has a flap attached thereto constitutes a bag of a pillow type, and the second sheet is inserted into the inside of the pillow type bag formed by the first sheet to serve as a partition.

The third process for manufacturing a dispenser-container provided with two containing spaces according to the present invention is characterized by:

feeding a second continuous sheet of a liquid impervious material having weakened lines for forming openings therein at a predetermined distance, and having flexible flaps for resealably covering the openings disposed thereon;

disposing contents in a wet condition at positions corresponding to the portions to be the openings onto a surface of the second continuous sheet opposite to that provided with the flaps;

overlaying the first sheet onto the contents;

fixing both longitudinal edges of the second sheet to the first sheet;

disposing contents in a dry condition at positions corresponding to the contents in a wet condition sandwiching the first sheet therebetween;

wrapping the contents in a dry condition by the first sheet to overlap longitudinal edges of the first sheet;

transversely sealing transverse openings of the first and second sheets; and transversely cutting the first and second sheets.

In the fourth process for manufacturing a dispenser-container provided with two containing spaces according to the present invention, the second sheet is overlaid on the contents in a wet condition after the contents in a wet condition are disposed on the first sheet, in place of overlaying the first sheet on the contents in a wet condition after the contents in a wet condition are disposed on the second sheet in the third process. According to this process, the contents in a dry condition may be supplied from beneath and may be wrapped by the first sheet from above.

According to the above-described third and fourth process, a dispenser-container is obtained, wherein the first sheet constitutes a bag of a pillow type, and the second sheet which has an opening and a flap attached thereto is fixed to the outside of the pillow type bag formed by the first sheet.

Further processes are characterized in that a straight weakened line has been previously formed near one of the longitudinal edges of the first sheet in the above-described various process, and the contents in a dry condition are wrapped by the first sheet to overlap the longitudinal edges of the first sheet, and then both the longitudinal edges are sealed. According to these processes, the weakened line such as a perforated line extending in a longitudinal direction in the obtained dispenser-container serves as an opening for dispensing contents in a dry condition.

An apparatus for manufacturing a dispenser-container provided with two containing spaces according to the present invention is characterized by:

means for feeding a first continuous sheet of a liquid impervious material;

means for feeding a second continuous sheet of a liquid impervious material;

one of the first sheet and the second sheet having weakened lines for forming openings at a predetermined distance, and having flexible flaps for resealably covering the openings, and the other sheet not being provided with flaps;

means for supplying contents in a wet condition between the first sheet and the second sheet;

means for supplying contents in a dry condition in such manner that they overlay with the contents in a wet condition sandwiching the other sheet therebetween;

means for fixing both longitudinal edges of one of the sheets to the other sheet;

means for guiding the other sheet so as to wrap the contents in a dry condition by the other sheet along a longitudinal direction of the other sheet;

means for transversely sealing the sheets; and means for transversely cutting the sheets.

The apparatus may further comprise means for slightly sealing longitudinal edges of the sheet wrapping the contents in a dry condition, means for forming a longitudinally extending weakened line near one of longitudinal edges of the sheet wrapping the contents in a dry condition, or means for sealing longitudinal edges of the sheet wrapping the contents in a dry condition.

BRIEF DESCRIPTION OF THE DRAWINGS

The present invention will now be explained in detail with reference to the accompanying drawings, wherein.

PREFERRED EMBODIMENTS

Embodiments will now be explained referring to FIGS. 1 to 3.

Figure 1:
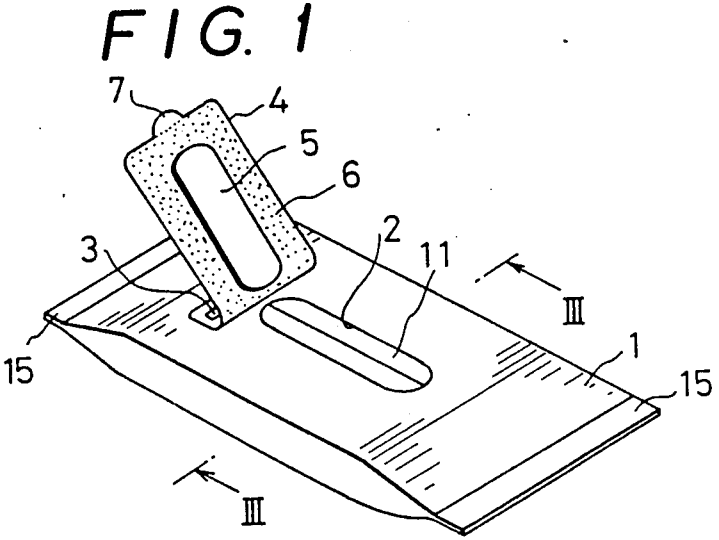
FIG. 1 is a perspective view, seen from one side, of an embodiment of a dispenser-container of the present invention.
Figure 2:
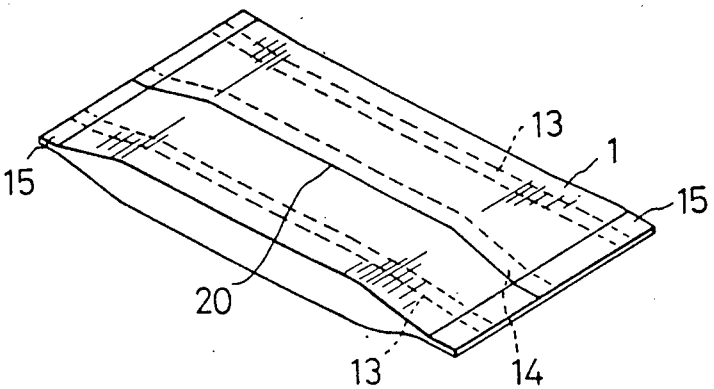
FIG. 2 is a perspective view showing the rear side of the dispenser-container illustrated in FIG. 1.
Figure 3:
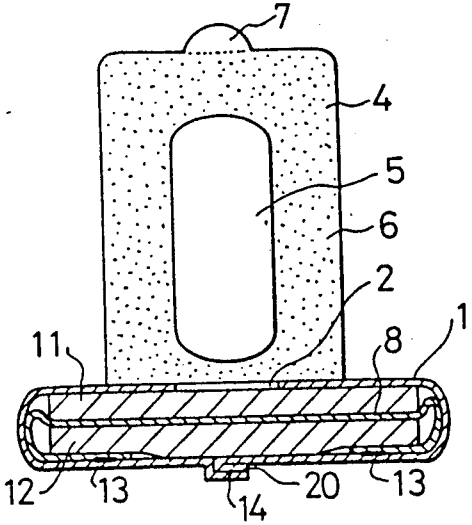
FIG. 3 is a cross sectional view, which is enlarged relative to FIGS. 1 and 2, taken along line III—III in FIG. 1.
Figure 4:
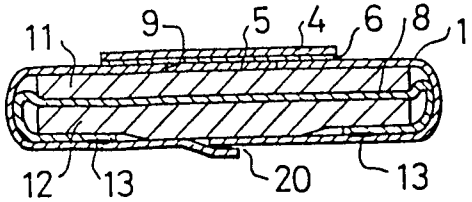
FIG. 4 is a cross sectional view of another embodiment wherein the flap is closed.

FIG. 1 is a perspective view, seen from one side, of an embodiment of a dispenser-container of the present invention;

FIG. 2 is a perspective view showing the rear side of the dispenser-container illustrated in FIG. 1;

FIG. 3 is a cross sectional view, which is enlarged relative to FIGS. 1 and 2, taken along line III—III in FIG. 1; and FIG. 4 is a cross sectional view of another embodiment wherein the flap is closed.

In the dispenser-container of the present invention, as illustrated, for example, in FIG. 3, a container body is provided with two containing spaces. One of the containing spaces contains contents 11 in a wet condition (wet tissues), and the other of the containing spaces contains contents 12 in a dry condition (tissue paper).

The container body of the present invention is a bag constituted by two flexible sheets 1 and 8 made of a liquid impervious material, respectively, more preferably, of a gas impervious material. One of the two sheets constitutes a bag of a pillow type, and this sheet will be referred to as "first sheet 1" hereinbelow. The other sheet 8, which will be referred to as "second sheet" hereinbelow, is fixed to the first sheet 1 at the inside of the pillow type bag or the outside of the pillow type bag.

A first embodiment will now be explained referring to FIGS. 1 to 3.

In the first embodiment illustrated in FIGS. 1 to 3, the flat pillow type bag 1 is made of the first sheet 1 which is liquid impervious, and more preferably, which is gas impervious. Both the ends of the bag 1 are sealed. The bag 1 is provided with a resealable flap 4 on one side thereof. The longitudinal edges of the sheet 1 are overlapping with each other, and are not sealed at all with each other or are sealed with each other in such an extent that they can be manually separated.

There is the second sheet 8 inside the bag 1. Inside the bag 1, the longitudinal edges of the second sheet 8 are fixed to the first sheet 1 by means of heat sealing, hot melt adhesive or ultra sonic sealing, and the fixed portion is denoted by reference numeral 13 in FIGS. 3 and 4. Then, both ends of the second sheet 8 are sealed together with the first sheet 1. Accordingly, the entire peripheries of the second sheet 8 are securely fixed to the first sheet 1.

The inside of the bag 1 is divided into two spaces by the second sheet 8. More specifically, in this embodiment, the second sheet 8 serves as a partition. Since the sheet 8 serving as a partition is arranged inside the bag 1 as described above, the dispenser-container of this embodiment appears like a single bag 1 in appearance and is provided with two containing spaces, where two kinds of different contents 11 and 12 can be stored.

Figure 9:
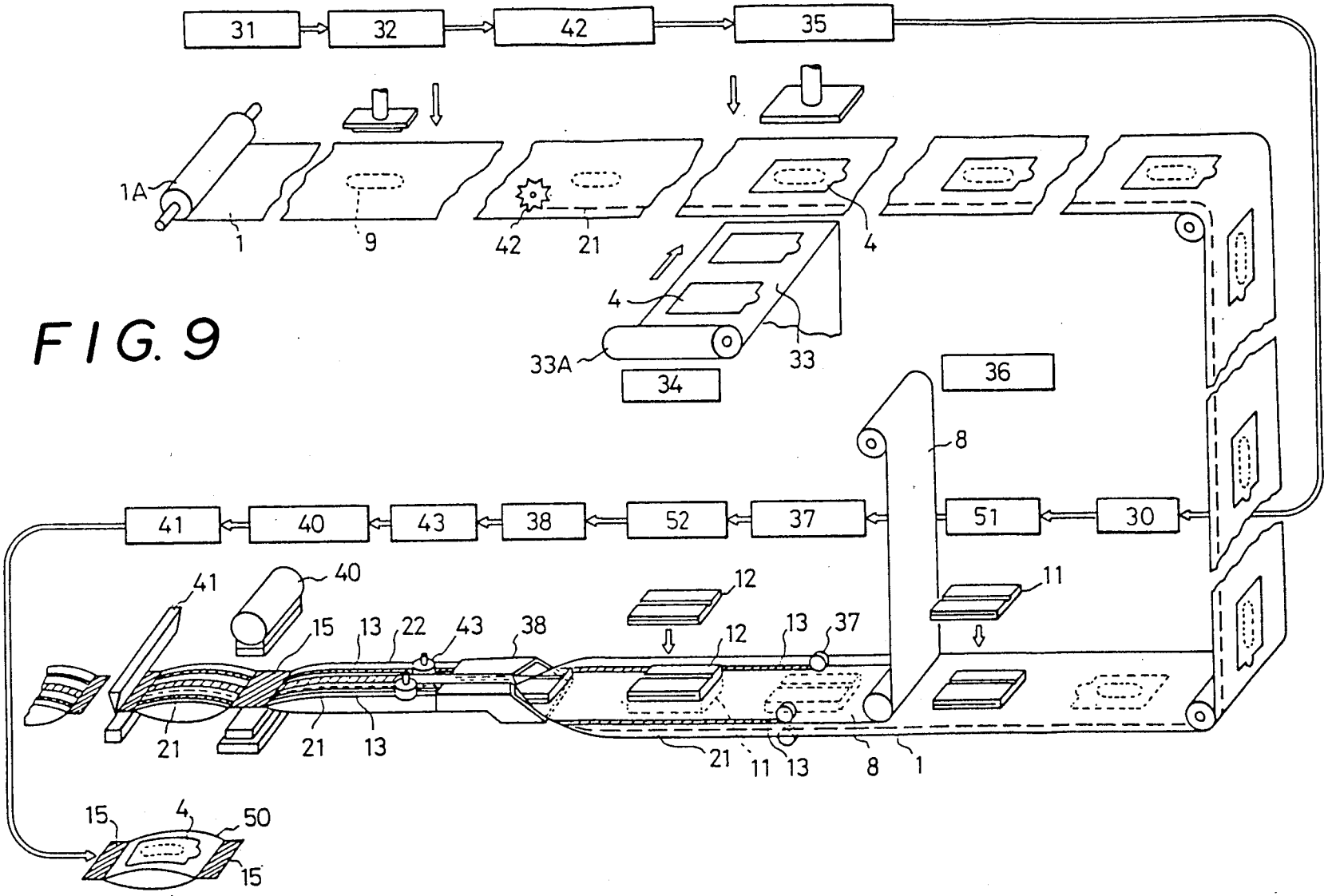
FIG. 9 is a flow diagram showing a process and an apparatus for manufacturing the third embodiment of the dispenser-container illustrated in FIGS. 7 and 8.

The bag 1 has on a side, which is provided with the resealable flap 4, an opening to permit dispensing of the contents in one of containing spaces therethrough, or a weakened line for forming the opening 2, such as a perforated line, which is denoted by reference numeral 9 in FIG. 9.

The shape of the dispensing opening 2 or the weakened line for forming the opening 2 may be formed in any suitable shape forming a closed loop, such as a circle, an ellipse, a rectangle, a rhombus or a shape forming an open loop such as U-shape. The flap 4 substantially covers the opening 2 or the weakened line.

A surface of the flap 4 has a layer of pressure sensitive adhesive 6 applied to substantially the entire surface contacting the outer surface of the bag 1, which surface of the flap 4 will be referred to as the "inside surface" hereinbelow.

The flap 4 may be only adhered to the bag 1. However, it is preferred for the flap 4 to be secured to the bag 1 so that it will not be removed from the bag 1 when it is opened. In order to achieve this purpose, there are many ways. Some examples will now be described. One end of the flap 4 may be securely fixed to the bag 1 by means of heat sealing, ultrasonic sealing or adhesive. The flap 4 may be provided at one end thereof with a pair of slits extending from longitudinal sides thereof. The flap 4 may have one or more slits at the central portion of one end thereof. Alternatively, the weakened line for forming the dispensing opening 2 may be formed in an open loop, e.g., U-shape.

In case that the weakened line for forming the dispensing opening 2 is formed, the portion 5 of the bag 1, i.e., the first sheet 1, which portion 5 is surrounded by the weakened line, is removed from the bag 1 when the dispenser-container is used first, and as a result, the portion 5 adheres to the adhesive layer 6 formed on the inside surface of the flap 4. The removed portion 5 substantially covers the opening 2 when the flap 4 is closed and serves as a seal for closing the opening 2, which will be referred to as a closing seal 5. In this case, the flap 4 is adhered to the bag 1 by means of the pressure sensitive adhesive layer 6 surrounding the closing seal 5 and hermetically seal the opening 2 of the bag 1.

In place of the above-described closing seal 5 which is constituted by a part of the bag 1, an opening 2 is formed in the bag 1, and a piece of another sheet, the size and the shape of which are almost the same as or slightly larger than those of the opening 2, may be adhered to the pressure sensitive layer 6 in such a manner that it covers the opening 2 as a closing seal.

Due to use of such closing seal 5, the closing seal 5 covers the opening 2, and accordingly, the contents 11 contained in the bag 1 do not directly contact with the pressure sensitive adhesive layer 6 under the sealed condition, wherein the flap 4 is closed. Thus, the contents 11 are kept clean. The closing seal 5 may be omitted, for example, in case that the pressure sensitive adhesive layer 6 is formed only at the periphery of the flap 4.

The above-described containing space with flap, i.e., the containing space, which is formed by the surface of the bag 1 with the flap 4 and the partition 8, can be hermetically sealed, and accordingly, this space is suitable for storing contents 11 in a wet condition, i.e., moistured fibrous materials such as wet tissues.

In case the contents 12 are in a dry condition, the contents do not require to be gas impervious, and accordingly, the flap may be omitted. Thus, in this embodiment, the other containing space is intended to mainly store contents 12 in a dry condition and is provided with no flaps.

On the other side of the bag (see FIGS. 2 and 3), an opening 20 for dispensing the contents 12 contained in the other containing space is formed and is provided with no flaps. The opening 20 may be formed as follows.

Longitudinal edges of the first sheet 1, which constitutes the bag 1, overlap each other on the surface opposite to that provided with the flap 4, as, for example, illustrated in FIG. 3. In this embodiment, the inside surfaces of the longitudinal edges face each other. The longitudinal edges are slightly sealed at 14 with each other by means of a weak heat sealing or weak adhesive, in such an extent that they can be manually separated. Upon use, the longitudinal edges are manually separated so that an opening 20 for dispensing the contents in a dry condition is formed.

Alternatively, the longitudinal edges of the first sheet 1 overlapping each other may not be sealed at all with each other so that an opening 20 is formed.

In a further embodiment, as illustrated in FIG. 4, a longitudinal edge of the first sheet 1 constituting the bag 1 is laid over the other longitudinal edge of the first sheet 1, and the longitudinal edges are kept unsealed so that an opening 20 is formed between the longitudinal edges.

When the longitudinal edges are slightly sealed at 14 with each other in such an extent that they can be manually separated, the longitudinal edges can be manually separated by a user upon use, and accordingly, the user is assured that nobody has taken the contents out of the containing space before the user uses the same.

The material of the first sheet 1 constituting the liquid impervious bag 1 may be a film made of synthetic resin such as polyethylene, polypropylene, polyamide, polyester, and polyvinyl chloride, and the film may be a single layer or a laminated layer. The film may be a laminated layer of the above-mentioned film and an aluminum sheet taking into consideration the contents.

It is preferred that material of the first sheet 1 is so selected that the first sheet 1 can be heat sealed. Alternatively, adhesive which has a hot melt property and which has a melting point lower than that of the first sheet 1 may be applied to at least the longitudinal edges of the bag 1.

The material of the second sheet 1 serving as the partition is liquid impervious, and preferably gas impervious. The material of the second sheet 8 may be a film made of synthetic resin such as polyethylene, polypropylene, polyamide, polyester, and polyvinyl chloride, and the film may be a single layer or a laminated layer. The film may be a laminated layer of the above-mentioned film and an aluminum sheet.

It is preferred that material of the second sheet 8 is so selected that the second sheet 8 can be heat sealed with the inside of the bag 1. Alternatively, adhesive which has a hot melt property and which has a melting point lower than that of the first sheet 1 may be applied to at least the longitudinal edges of the second sheet 8.

Since the second sheet 8 is used as the partition in the embodiments illustrated in FIGS. 1 to 4, it is preferred that the thickness of the second sheet 8 is thinner than that of the first sheet 1 and that second sheet is more flexible than the first sheet 1.

The material of the flap 4 may be similar to that exemplified for the first sheet 1.

With regard to the shape and the size of the flap 4, the area of the flap 4 is larger than that of the opening 2, and the shape is preferably a circle, an ellipse, a rectangle or a rhombus so as to be aesthetic.

It is preferred that the pressure sensitive adhesive layer 6 applied to the inside of the flap 4 is acrylic, rubber, polyester, polyolefin or resin adhesive. The application of the adhesive may be done by any suitable method, such as a roll coat, knife coat, spray coat and so on.

If the flap is a transparent sheet, the conditions of the contents and the opening 2 can be see from the outside.

Further, the flap 4 is provided with a grip 7 formed in a bulged portion at an end opposite to the fixed end 3 of the flap 4, and the grip 7 is used by the user to open the flap 4. It is preferred that the pressure sensitive adhesive layer 6 is not applied to this grip 7 as illustrated in FIGS. 1 and 3.

The method for securely fixing the flap 4 to the bag 1 can be done by any suitable method, such as heat seal, ultrasonic seal, high frequency seal, seal by adhesive, in accordance with the material of the bag 1. Alternatively, the flap 4 may be provided at one end thereof with a pair of slits extending from longitudinal sides thereof or one or more slits at the central portion of one end thereof so that removal of the flap 4 beyond the slits is prevented.

A process and apparatus for manufacturing the embodiment of the dispenser-container illustrated in FIGS. 1 to 3 will now be discussed with reference to FIG. 5.

A continuous sheet, i.e., the first sheet 1, to be formed in the bag 1 is fed from a roll 1A by a suitable feed device 31 such as a feed roller.

Then, a weakened line, such as a perforated line, for forming opening 2 of a suitable shape is formed by a punching machine 32.

Separately, flaps 4, having pressure sensitive adhesive layer, such as acrylic ester adhesive or rubber adhesive, coated on one side thereof for an extent at least larger than the opening, are prepared. For example, a continuous released paper 33 having a plurality of flaps 4 adhered thereto is wound on a roll 33A, which is fed by means of a suitable feed device 34, such as feed roller, to supply the flaps 4.

The flap 4 is removed from the released paper 33 and is adhered to the first sheet 1 by means of a known suitable device 35 such as a labelling machine or by manual operation in such a manner that the side with the pressure sensitive adhesive of the flap 4 covers the weakened line 9 of the first sheet 1, which seat is obtained in the previous step.

In case one end of the flap 4 is securely fixed to the first sheet 1 to be the bag by heat sealing, the heat sealing may be done by an appropriate device such as a heat sealer (not shown) which is disposed after the previous station. This heat sealing process may be omitted when the secure fixing is done by a method other than the heat sealing, such as formation of slits or application of adhesive, or when the flap 4 is only adhered to the first sheet 1.

The thus obtained first sheet 1 provided with the weakened lines 9 and the flaps 4 may be directly and continuously transferred to the succeeding station by means of an appropriate device, such as a feed roller, or may be once wound on a bobbin to form a roll (not shown), from which the first sheet 1 is then fed to the next station by means of a suitable device 30 such as a feed roller. When the first sheet is continuously fed to the next station, it is convenient because a winding station and winding apparatus are unnecessary though the the previous station and the succeeding station must be synchronized. Contrary to this, when the first sheet is once wound and is fed to the next station, it is convenient because the timings for forming the weakened line 9 and for adhering the flaps are not required to be synchronized with the timings in the succeeding station for supplying contents 11 and 12 and for packaging them, and further, the apparatus in the previous station and that in the succeeding station can be separately disposed, and individual apparatuses may be compact.

Thereafter, sheet-like fibrous materials (wet tissues) 11 made of, for example, synthetic or natural paper, woven fabrics, non-woven fabrics, cut cotton layers for toilet use, gauze, absorbent cotton, or foam sheet, impregnated with or applied with cosmetics, cleaning liquid, medecine or the like are fed onto the first sheet 1, obtained in the previous station, by means of a supply device 51. In this case, the sheet-like fibrous materials 11 are disposed on portions of the first sheet 1, where openings 2 will be formed, on the side opposite to that provided with the flaps 4. In other words, the sheet-like fibrous materials 11 are disposed in such a manner that the flap 4 faces outward in the obtained dispenser-container.

The supply device 51 may be any suitable device which has been conventionally used to transfer and supply articles to be packed in packaging apparatuses. For example, the supply device 51 may be a chain conveyor with attachments which horizontally transfers articles at a predetermined distance therebetween and feeds them one by one in synchronization with the feed of the wrapping sheet. The supply device 51 may be a material handling equipment which grips and takes up the uppermost or lowermost article one by one from the articles to be packed which are vertically stacked. The supply device 51 may be a combination of a conveyor for horizontally transferring articles to be packed and material handling equipment which grips and takes up the articles one by one.

The second sheet 8 is withdrawn form roll 8A by an appropriate feed device 36 such as a feed roller and is laid onto the sheet-like fibrous materials 11 in a wet condition. Then, the longitudinal edges of the second sheet 8 are securely fixed to the first sheet 1 in a longitudinal direction, i.e., heat sealed in this embodiment. The securely fixed portion is denoted by reference numeral 13. The secure fixing can be effected by any suitable means, such as heat sealing by means of a side sealer 37, by adhering by means of adhesive, preferably, hot melt adhesive, or by an ultrasonic sealing.

Sheet-like fibrous materials in a dry condition 12, i.e., tissue paper, are supplied by means of the supply device 52 onto the sheet-like fibrous materials 11 in a wet condition in such a manner that the sheet-like fibrous materials 11 and 12 sandwich the second sheet 8 therebetween. Similar to the above-described supply device 51, the supply device 52 may be conventionally known apparatus and may have a construction similar to that of the supply device 51.

In the foregoing explanation, after the longitudinal edges of the second sheet 8 are securely fixed to the first sheet 1, the dry sheet-like fibrous materials 12 are disposed onto the second sheet 8. The sequence may be reversed, i.e., after the sheet-like fibrous materials 12 in a dry condition are disposed onto the second sheet 8, the longitudinal edges of the second sheet 8 may be securely fixed to the first sheet 1.

Thereafter, the first sheet 1 is guided by a former 38 to wrap the wet sheet-like fibrous materials 11, the second sheet 8 and the dry sheet-like fibrous materials 12 by the first sheet 1, and the longitudinal edges of the first sheet 1 are overlapped with each other.

The longitudinal edges of the first sheet 1, which overlap each other, are slightly heat sealed with each other by means of a center heat sealer 39 in such an extent that they can be manually separated later. The heat sealed portion is denoted by reference numeral 14. The longitudinal edges of the first sheet 1 may not be sealed at all though they overlap each other.

The transverse openings of the first sheet 1 and the second sheet 8, which constitute the bag 1, are securely sealed together at portions ahead and behind the stacked contents 11 and 12 by means of a conventionally known sealing device 40, such as a heat sealer or an ultrasonic sealer. The heat sealed portions are denoted by reference numeral 15.

The transversely sealed portions 15 are cut by a cutting device 41 into individual bags to form the dispenser-container 50, of the present invention. In FIG. 5 the dispenser-container 50 is illustrated in such a condition that the wet sheet-like fibrous materials 11 are located at an upper position and the flap 4 can be seen.

Various embodiments of process and apparatus for manufacturing the embodiment of the dispenser-container of the present invention, which are different from the above-described embodiment will now be explained. In these embodiments, the articles, parts and devices the same as those illustrated in FIGS. 1 to 5 are denoted by the same reference numerals, and their further detailed explanation is omitted.

Figure 6:
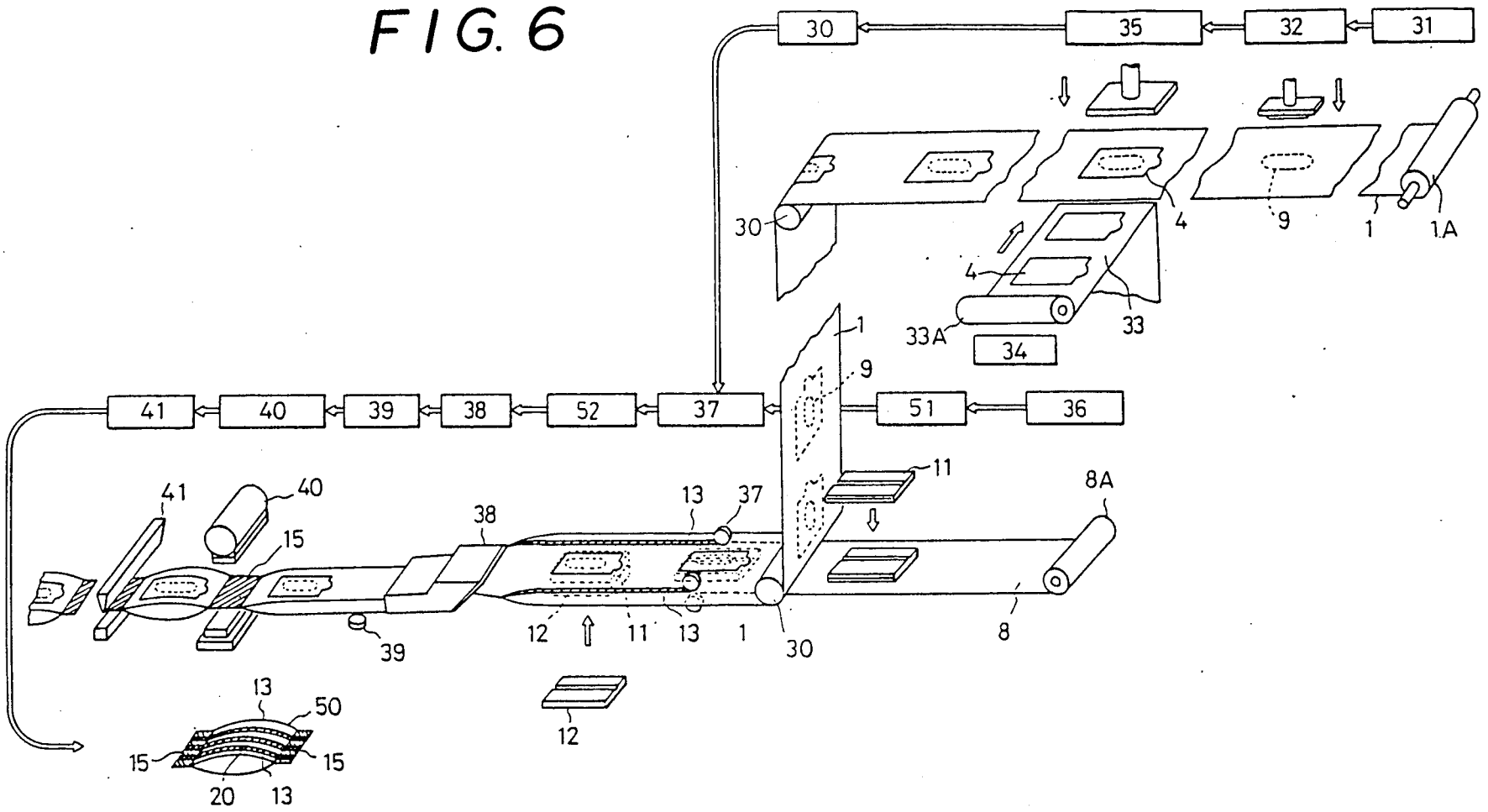
FIG. 6 is a flow diagram showing another process and apparatus for manufacturing the embodiment of the dispenser-container illustrated in FIGS. 1 to 3.

FIG. 6 is a flow diagram showing another process and apparatus for manufacturing the embodiment of the dispenser-container illustrated in FIGS. 1 to 3, or that illustrated in FIG. 4.

Figure 5:
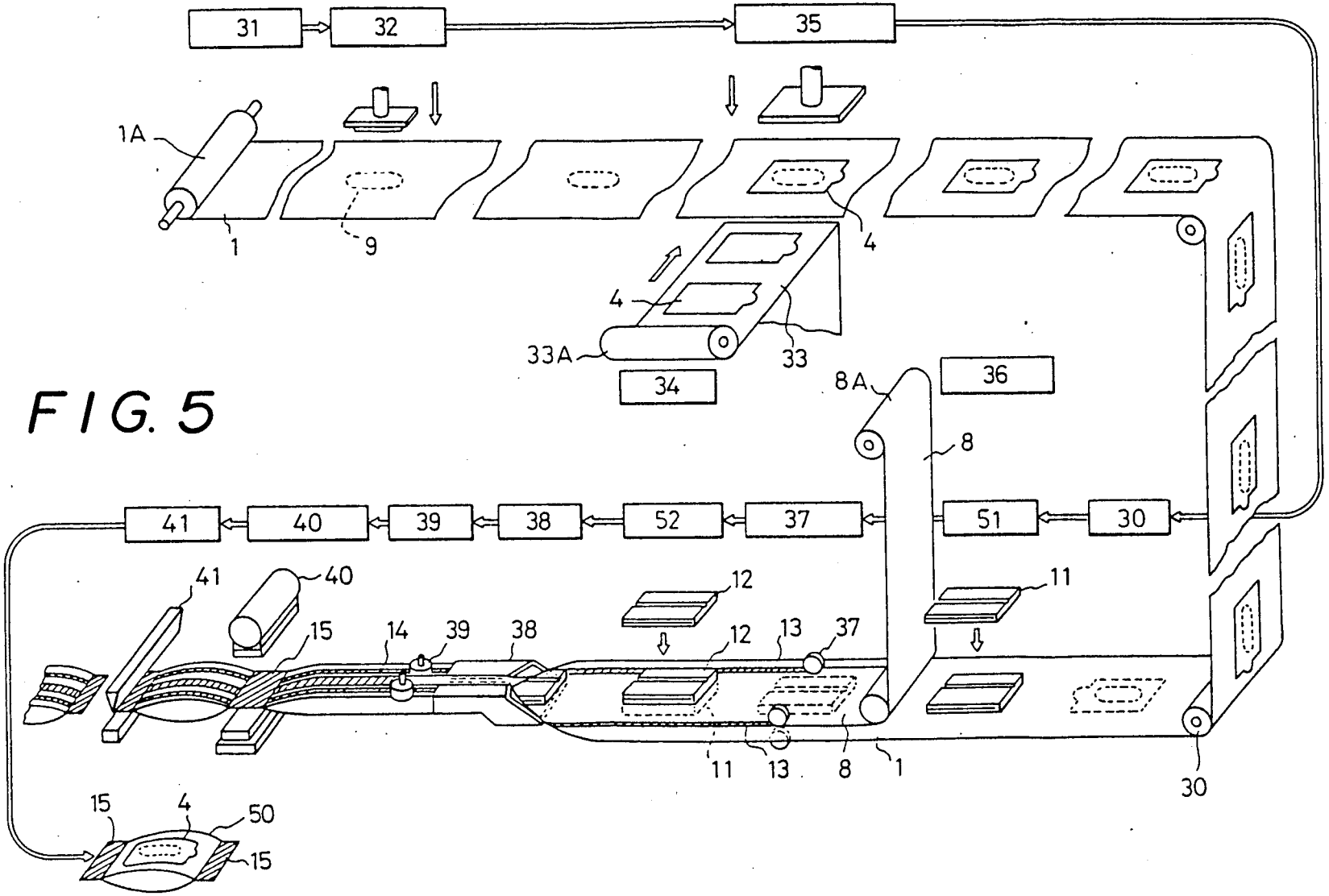
FIG. 5 is a flow diagram showing a process and apparatus for manufacturing the embodiment of the dispenser-container illustrated in FIGS. 1 to 3.

In the process and the apparatus illustrated in FIG. 6, the process and the apparatus before the formation of weakened lines 9 for forming opening 2 in the first sheet 1 and adhering the flaps covering the openings 2 are similar to those illustrated in FIG. 5. Thus, the first sheet 1 provided with weakened lines 9 and the flaps 4 are prepared and are fed to the next station by means of the feed device 30.

The process illustrated in FIG. 6 is different from that illustrated in FIG. 5 in the following points.

Although the wet sheet-like fibrous materials were disposed onto the first sheet 1 in the embodiment illustrated in FIG. 5, the wet sheet-like fibrous materials 11 are disposed onto the second sheet 8 in the process illustrated in FIG. 6, and the first sheet 1 is laid onto the wet sheet-like fibrous materials 11. In this instance, the first sheet 1 is laid onto the wet sheet-like fibrous materials 11 in such manner that the weakened lines 9 in the first sheet 1 correspond to the wet sheet-like fibrous materials 11 and that the side with the flaps 4 faces outside. Then, after the longitudinal edges of the second sheet 8 are securely fixed to the first sheet 1 in a longitudinal direction (the securely fixed portion is denoted by reference numeral 13), sheet-like fibrous materials in a dry condition 12 are supplied from below to positions corresponding to the wet sheet-like fibrous materials in such a manner that the sheet-like fibrous materials 11 and 12 sandwich the second sheet 8 therebetween.

Thereafter, the first sheet 1 is guided by a former 38 so that the first sheet 1 wraps the wet sheet-like fibrous materials 11, the second sheet 8 and the dry sheet-like fibrous materials 12 form above, and that the longitudinal edges of the first sheet 1 are overlapped with each other. The overlapping longitudinal edges cannot be seen because the are on the rear side.

The dispenser-container 50 of the present invention is obtained in accordance with process similar to that explained with reference to FIG. 5. More specifically, the longitudinal edges of the first sheet 1, which overlap each other, are slightly heat sealed with each other by means of a center heat sealer 39 in such an extent that they can be manually separated later, the heat sealed portion being denoted by reference numeral 14, or are not sealed at all though they overlap each other. Then, the transverse openings of the first sheet 1 are securely sealed together at portions ahead and behind the stacked contents 11 and 12, heat sealed portions being denoted by reference numeral 15, by means of a sealing device 40. Thereafter, the transversely sealed portions 15 are cut by a cutting device 41 to into individual bags.

In FIG. 6, the obtained dispenser-container 50 is illustrated in such a condition that the dry sheet-like fibrous materials 12 are located at an upper position and the opening 20 for dispensing dry sheet-like fibrous materials can be seen. In short, the dispenser-container illustrated in FIG. 6 is seen from the side opposite to that of FIG. 5.

Figure 7:
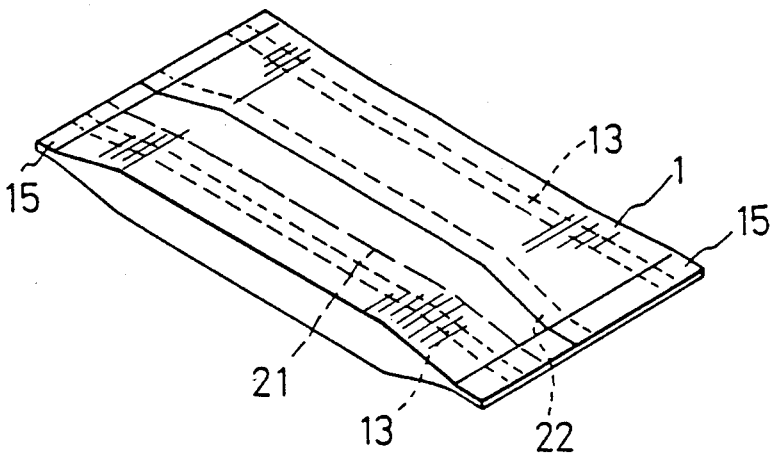
FIG. 7 is a perspective view of a third embodiment of a dispenser-container of the present invention, wherein an opening for dispensing sheet-like materials in a dry condition faces upwardly.
Figure 8:
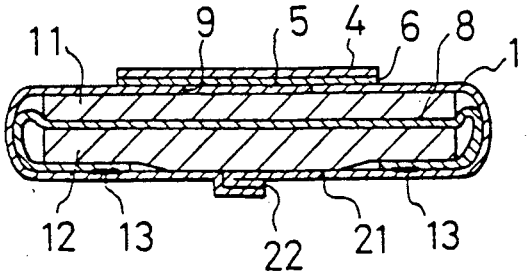
FIG. 8 is a cross sectional view of the third embodiment illustrated in FIG. 7, which view is similar to FIG. 4.

FIG. 7 is a perspective view of another embodiment of a dispenser-container of the present invention, wherein an opening 22 for dispensing sheet-like fibrous materials 12 in a dry condition faces upward. FIG. 8 is a cross sectional view of the embodiment illustrated in FIG. 7, which view is similar to FIG. 4.

The dispenser-container of this third embodiment differs from that of the first embodiment, i.e., the dispenser-container illustrated in FIGS. 1 to 3.

In this embodiment, as illustrated in FIG. 7, a perforated line 21 for forming an opening to permit dispensing of the dry sheet-like fibrous materials 12 is formed in the first sheet 1 on a side of the bag 1, which side is not provided with the resealable flap 4. The overlapping longitudinal edges of the first sheet 1 are sealed. The sealed portion is designated by reference numeral 22.) Accordingly, the third embodiment differs form those illustrated in FIGS. 1 to 3 and 4 in that the longitudinal edges of the first sheet 1 do not serve as an opening for dispensing the dry sheet-like fibrous materials 12. Upon use, the straight weakened line 21 formed in the first sheet 1 is torn to form an opening, which serves to dispense dry sheet-like fibrous materials 12.

The remaining constructions of this embodiment are substantially the same as those of the first embodiment.

A process and an apparatus for manufacturing the dispenser-container illustrated in FIGS. 7 and 8 will now be explained.

FIG. 9 illustrates an embodiment of the manufacturing process and is substantially the same as that illustrated in FIG. 5 except for the following.

A weakened line 21 extending longitudinally is formed near one of the longitudinal edges of the first sheet 1 by means of a perforated line forming device 42. Although the formation of the perforated line 21 is illustrated to be just after the punching process effected by the punching machine 32 in FIG. 9, the location is not limited to the above-described position as long as it is before the wrapping of the sheet-like fibrous materials 11 and 12 by the first sheet 1, i.e., before the former 38.

Further, after two kinds of sheet-like fibrous materials 11 and 12 are wrapped by the first sheet 1 and the longitudinal edges of the first sheet 1 are overlapped, the overlapped longitudinal edges of the first sheet 1 are heat sealed by the center heat sealer 43. (The sealed portion is designated by reference numeral 22.) Accordingly, different from the embodiment illustrated in FIG. 5, the longitudinal edges of the first sheet 1 do not provide an opening for dispensing dry sheet-like fibrous materials 12. Instead, the perforated line 21 formed in the first sheet 1 becomes a dispensing opening for the sheet-like fibrous materials 12.

Other constructions of this embodiment are similar to those of the embodiment illustrated in FIG. 5.

Figure 10:
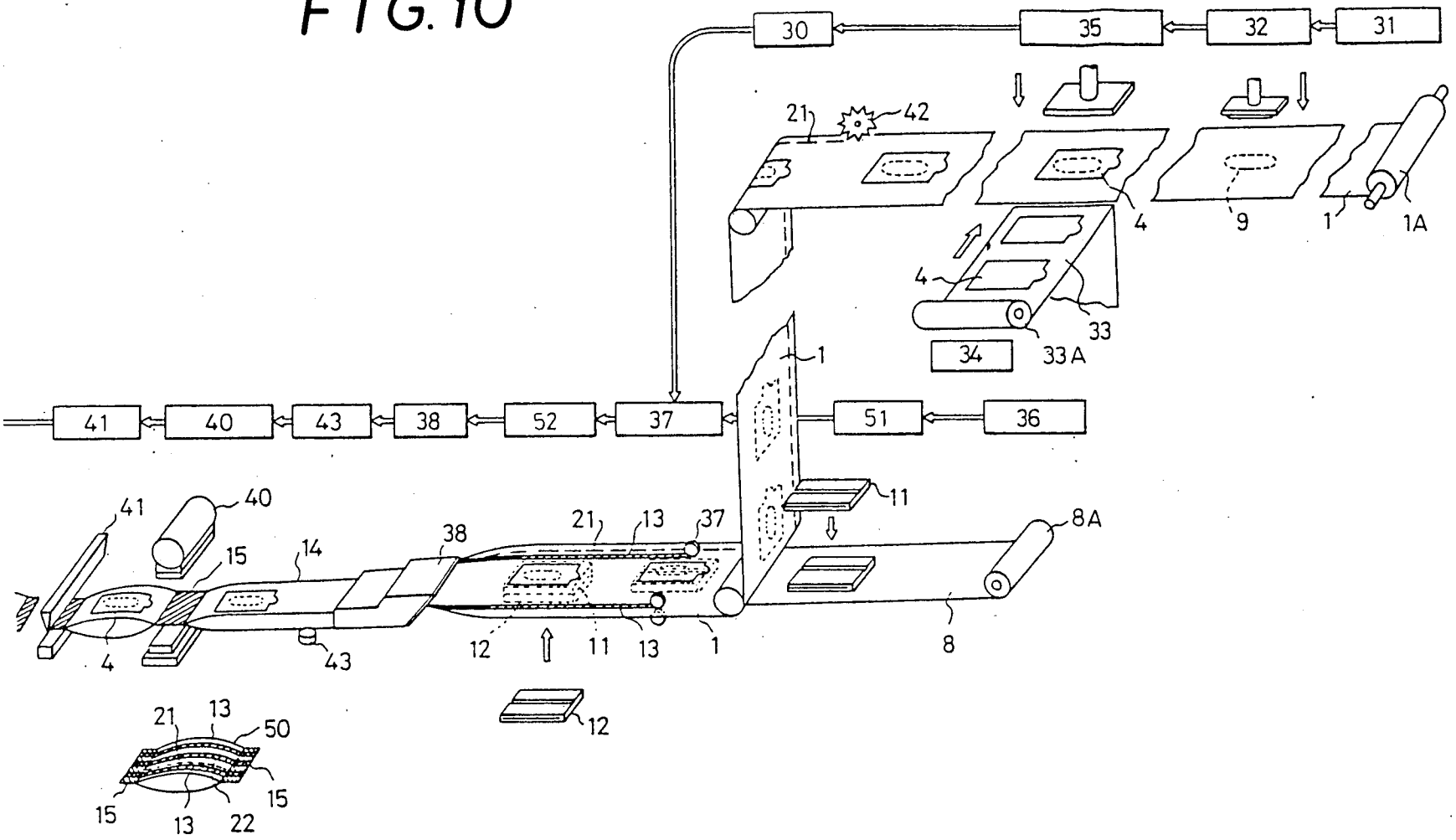
FIG. 10 is a flow diagram showing another process and apparatus for manufacturing the embodiment of the dispenser-container illustrated in FIGS. 7 and 8.

FIG. 10 is a flow diagram showing another process and apparatus for manufacturing the embodiment of the dispenser-container illustrated in FIGS. 7 and 8, and it is generally similar to FIG. 6 but is differs from FIG. 6 in the points explained with reference to FIG. 9.

More specifically, this embodiment differs from that illustrated in FIG. 6 in that a weakened line 21 extending longitudinally is formed near one of the longitudinal edges of the first sheet 1 by means of a perforated line forming device 42; and in that after two kinds of sheet-like fibrous materials 11 and 12 are wrapped by the first sheet 1 and the longitudinal edges of the first sheet 1 are overlapped, the overlapped longitudinal edges of the first sheet 1 are heat sealed by the center heat sealer 43.

Although FIG. 10 illustrates that the formation of the perforated line 21 is done just after the punching process by the punching machine 32 similarly to that in FIG. 9, the location is not limited to the above-described position as long as it is before the wrapping of the sheet-like fibrous materials 11 and 12 by the first sheet 1.

Other constructions of this embodiment are similar to those of the embodiment illustrated in FIG. 6.

Figure 11:
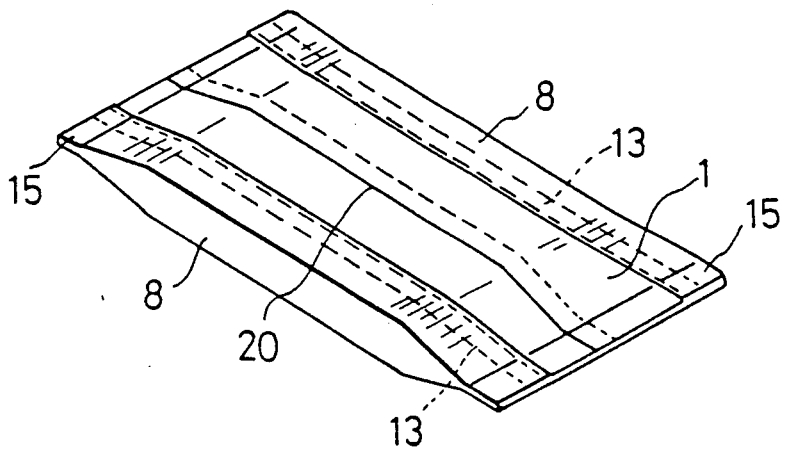
FIG. 11 is a perspective view of a fourth embodiment of a dispenser-container of the present invention, wherein an opening for dispensing sheet-like materials in a dry condition faces upwardly.
Figure 12:
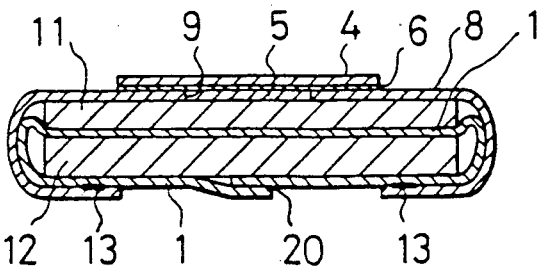
FIG. 12 is a cross sectional view of the fourth embodiment illustrated in FIG. 11, which view is similar to FIG. 4.

FIG. 11 is a perspective view of a still further embodiment of a dispenser-container of the present invention, wherein an opening for dispensing sheet-like materials 12 in a dry condition faces upward, and FIG. 12 is a cross sectional view of the embodiment illustrated in FIG. 11, which view is similar to FIG. 4.

The dispenser-container of this fourth embodiment differs from that of the first embodiment, i.e., the dispenser-container illustrated in FIGS. 1 to 3.

In the first embodiment, the second sheet 8 is located inside the pillow type bag formed by the first sheet 1. Contrary to this, in this embodiment illustrated in FIGS. 11 and 12, the second sheet 8 is located outside the pillow type bag 1 formed by the first sheet 1.

The longitudinal edges of the second sheet 8 are securely fixed to the first sheet 1 at the outside of the pillow type bag 1 by means of heat sealing, ultrasonic sealing, hot melt adhesive and so on, and the securely sealed portion is denoted by reference numeral 13. The ends of the second sheet 8 are securely fixed at the ends of the first sheet 1 by means of heat sealing, ultrasonic sealing, hot melt adhesive and so on.

Accordingly, in the dispenser-container of this embodiment, a containing space is formed between the second sheet 8 and the first sheet 1, and at the same time, another containing space is formed by a pillow type bag formed by the first sheet 1. Thus, although the dispenser-container of the fourth embodiment has an appearance similar to a regular pillow type bag and is compact, it is provided with two containing spaces like the first embodiment. The containing space formed between the second sheet 8 and the first sheet 1 contains the wet sheet-like fibrous materials 11, and the containing space formed by the first sheet 1 contains dry sheet-like fibrous materials 12.

Further, in this fourth embodiment, the perforated line 9 for forming an opening for dispensing the wet sheet-like fibrous materials 11 is formed in the second sheet 8, and the flap 4 for resealably covering the portion surrounded by the perforated line 9 for forming the opening is also adhered to the second sheet 8.

This embodiment is substantially the same as the first embodiment except that the opening, i.e., the perforated line 9, and the flap 4 are disposed on the second sheet 8.

Similar to the embodiment illustrated in FIG. 4, the opening 20 for dispensing the dry sheet-like fibrous materials 12 is formed by overlapping the longitudinal edges of the first sheet 1 forming the pillow type bag, which edges are kept unsealed.

The remaining constructions are similar to those of the first embodiment.

A process and an apparatus for manufacturing the dispenser-container illustrated in FIGS. 11 and 12 will now be explained.

Figure 13:
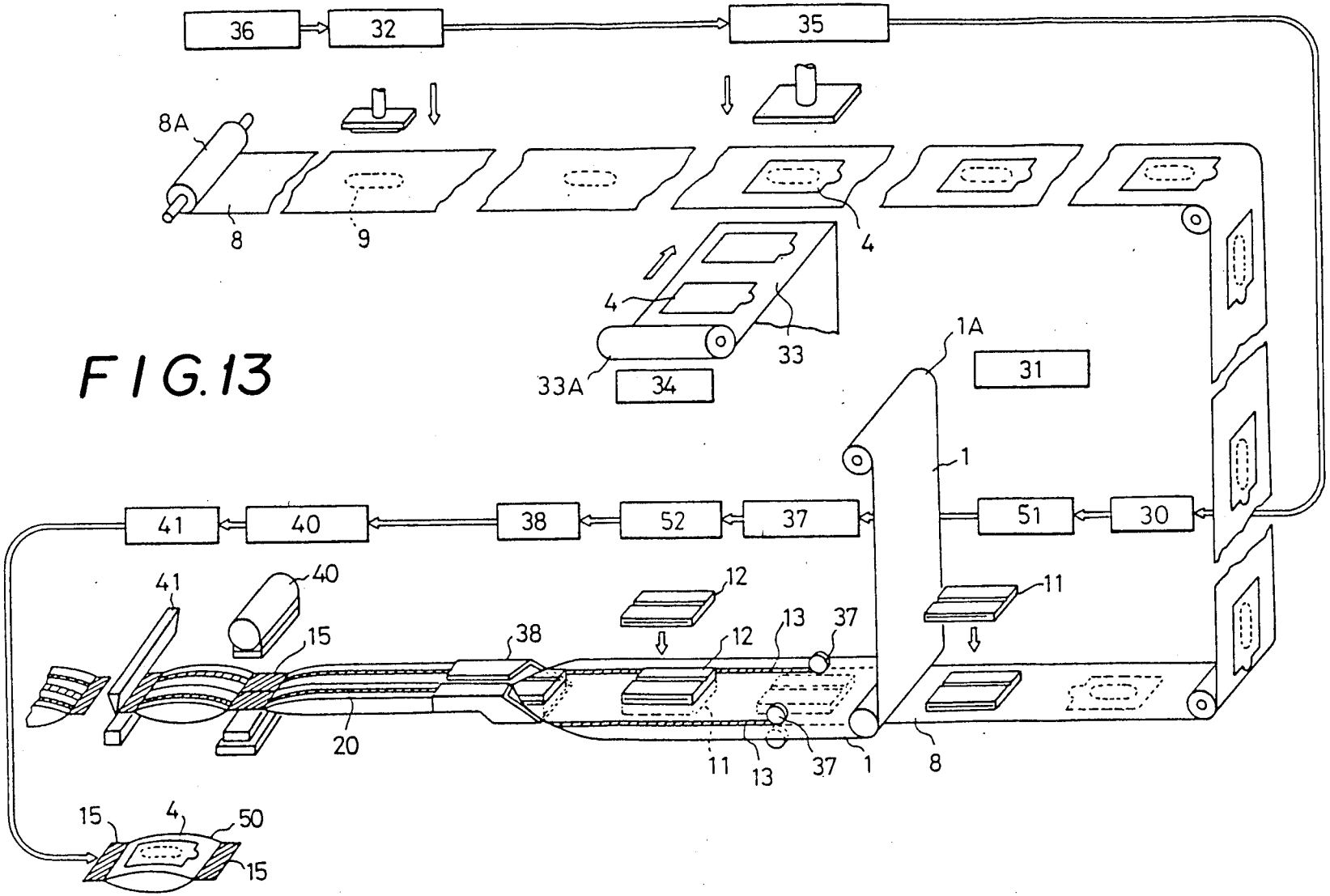
FIG. 13 is a flow diagram showing a process and an apparatus for manufacturing the fourth embodiment of the dispenser-container illustrated in FIGS. 11 and 12.

FIG. 13 is an embodiment of the manufacturing process and is similar to the process and apparatus illustrated in FIG. 5 except for the following.

In the embodiment illustrated in FIG. 5, the first sheet 1 for forming the pillow type bags was provided with the weakened lines 9, i.e., the perforated lines, and the flaps 4. Contrary to this, in the embodiment of FIG. 13, the second sheet 8 is withdrawn from the roll 8A, and the weakened lines 9, i.e., perforated lines, are formed in the second sheet 8, and the flaps 4 are attached to the second sheet 8 by means of a conventionally known labeling device 35 or by hand in such a manner that the portions, which have pressure sensitive adhesive coated thereon, of the flaps 4 cover the weakened lines 9.

The thus obtained second sheet 8 provided with the weakened lines 9 and the flaps 4 may be directly and continuously transferred to the succeeding station by means of an appropriate feed device 30, such as a feed roller, or may be once wound on a bobbin to form a roll (not shown), from which the first sheet 1 is then fed to the next station by means of a suitable device 30 such as a feed roller.

Thereafter, sheet-like fibrous materials (wet tissues) 11 made of, for example, synthetic or natural paper, woven fabrics, non-woven fabrics, cut cotton layers for toilet use, gauze, absorbent cotton, or foam sheet impregnated with or applied with cosmetics or medicine are fed onto the second sheet 1, obtained in the previous station, by means of a supply device 51. In this case, the sheet-like fibrous materials 11 are disposed on portions of the second sheet 8, where openings 2 will be formed, on the side opposite to that provided with the flaps 4. In other words, the sheet-like fibrous materials 11 are disposed in such a manner that the flap 4 faces outward in the obtained dispenser-container.

The first sheet 1 is withdrawn form roll 1A by an appropriate feed device 31 and is laid onto the sheet-like fibrous materials 11 in a wet condition. Then, the longitudinal edges of the second sheet 8 are securely fixed to the first sheet 1, the securely fixed portion being denoted by reference numeral 13.

Sheet-like fibrous materials in a dry condition 12, i.e., tissue paper, are supplied by means of the supply device 52 onto the sheet-like fibrous materials in a wet condition 11 in such a manner that the sheet-like fibrous materials 11 and 12 sandwich the first sheet 1 therebetween.

Thereafter, the first sheet 1 and the second sheet 8 are guided by a former 38 to wrap the dry sheet-like fibrous materials 12 by the first sheet 1, and the longitudinal edges of the first sheet 1 are overlapped with each other. The longitudinal edges of the first sheet 1 may not be sealed at all though they overlap each other.

The transverse openings of the first sheet 1 and the second sheet 8 are securely sealed together at portions ahead and behind the stacked contents 11 and 12 by means of a conventionally known sealing device 40, such as a heat sealer or an ultrasonic sealer. The heat sealed portions are denoted by reference numeral 15.

The remaining features are the same as those of the process and apparatus illustrated in FIG. 5.

Figure 14:
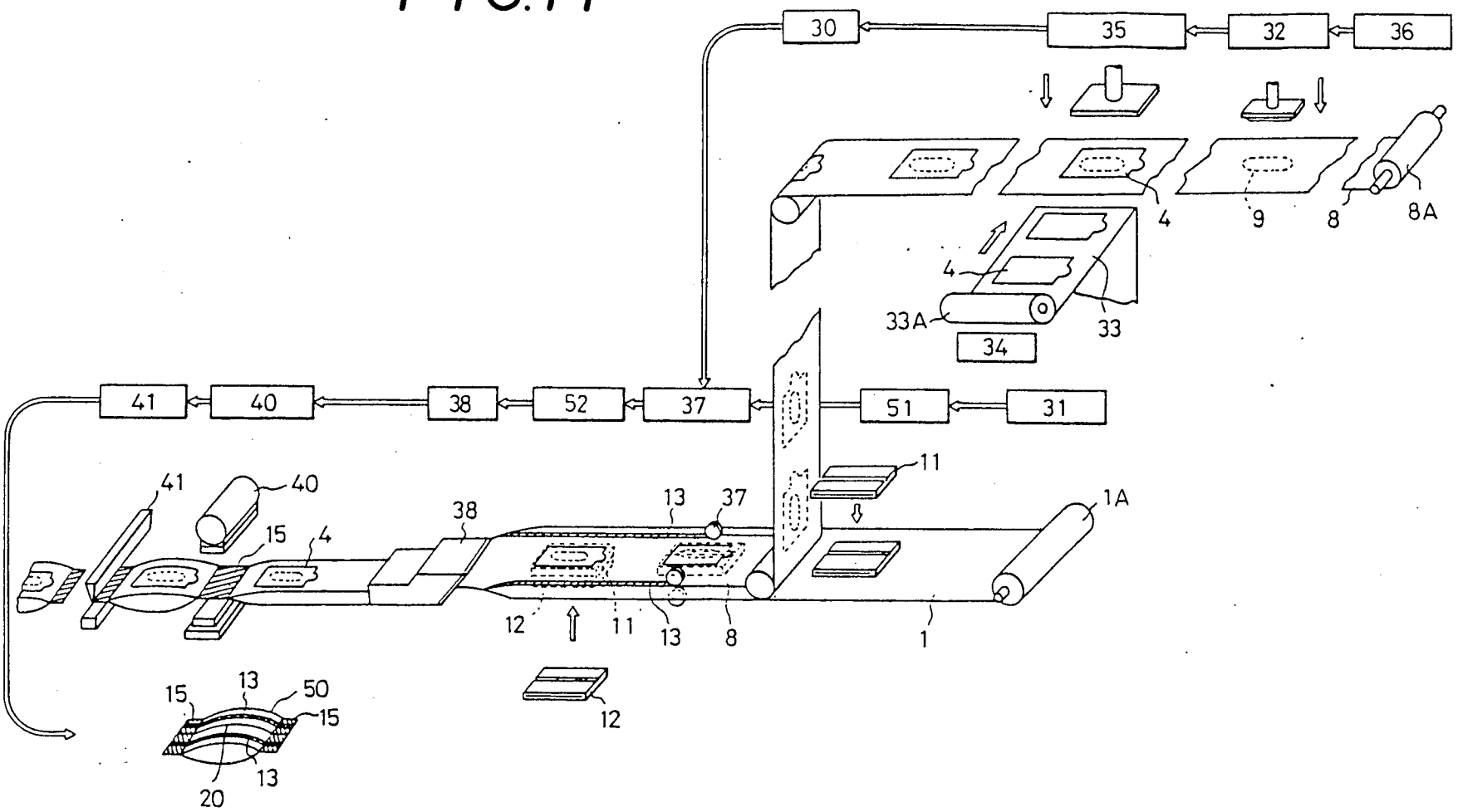
FIG. 14 is a flow diagram showing another process and apparatus for manufacturing the embodiment of the dispenser-container illustrated in FIGS. 11 and 12.

FIG. 14 is a flow diagram showing another process and apparatus for manufacturing the embodiment of the dispenser-container illustrated in FIGS. 11 and 12.

In the process and the apparatus illustrated in FIG. 14, the steps before the formation of the weakened lines 9 for forming the openings 2 in the second sheet 8 and attachment of the flaps 4 for covering the openings 2 are similar to those illustrated in FIG. 13.

The process illustrated in FIG. 14 is different from that illustrated in FIG. 13 in the following points.

Although the wet sheet-like fibrous materials 11 were supplied onto the openings 2 in the embodiment illustrated in FIG. 13, the wet sheet-like fibrous materials 11 are disposed on the first sheet 1, over which the second sheet 8 is laid in the embodiment illustrated in FIG. 14. In this instance, the second sheet is laid on the wet sheet-like fibrous materials 11 in such a manner that the weakened lines 9 of the second sheet 8 correspond to the wet sheet-like fibrous materials 11 and that the surface provided with the flaps 4 faces outward. Then, the longitudinal edges of the second sheet 8 are securely fixed to the first sheet 1. Thereafter, the dry sheet-like fibrous materials 12 are supplied from beneath to positions corresponding to the wet sheet-like fibrous materials 11. The former 38 assists the first sheet 1 to wrap the dry sheet-like fibrous materials 12 from above and overlap the longitudinal edges of the first sheet 1. The overlapping edges cannot be seen in FIG. 14 since they are below the dispenser-container.

Similar steps to those explained with reference to FIG. 13 are carried out, and the dispenser-container 50 of the present invention is obtained. More specifically, the transverse openings of the first sheet 1 are securely sealed together at portions ahead and behind the stacked contents 11 and 12 by means of a conventionally known sealing device 40, such as a heat sealer or an ultrasonic sealer. The transversely sealed portions 15 are cut by a cutting device 41 into individual bags to form the dispenser-containers 50, of the present invention. In FIG. 14, the obtained dispenser-container 50 is illustrated in such a condition that the dry sheet-like fibrous materials 12 are located at an upper position and the opening 20 for dispensing the sheet-like fibrous materials 12 can be seen. In other words, in FIG. 14, this dispenser-container is observed in a direction opposite to that in FIG. 13.

Figure 15:
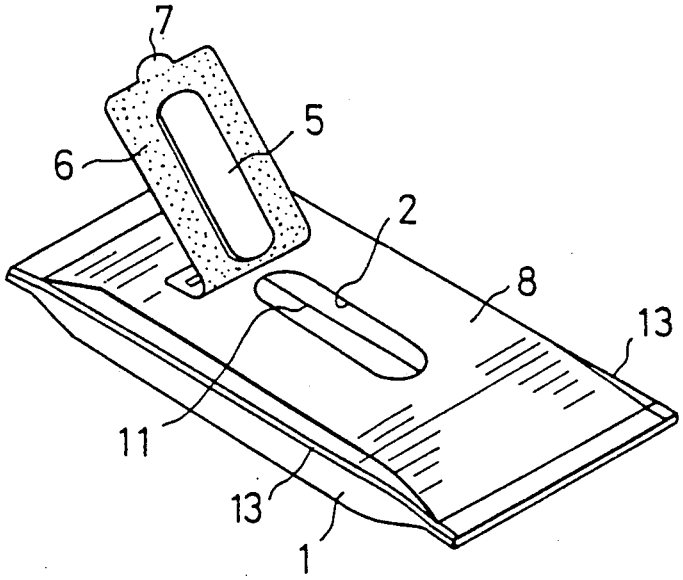
FIG. 15 is a perspective view of a fifth embodiment of a dispenser-container of the present invention, wherein an opening for dispensing sheet-like materials in a wet condition faces upwardly.
Figure 16:
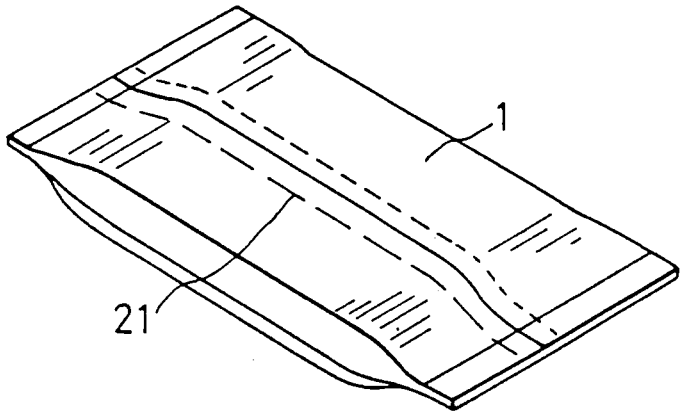
FIG. 16 is a perspective view showing the rear side of the dispenser-container of the fifth embodiment.
Figure 17:
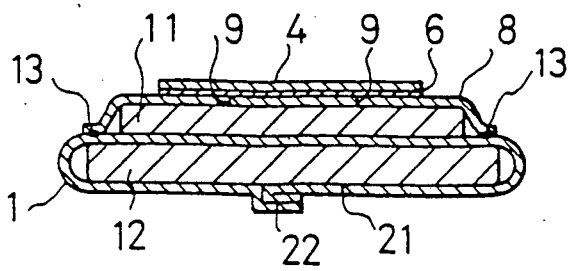
FIG. 17 is a cross sectional view of the embodiment illustrated in FIGS. 15 and 16, which view is similar to FIG. 4.

FIG. 15 is a perspective view of another embodiment of a dispenser-container of the present invention, wherein an opening 2 for dispensing sheet-like materials 11 in a wet condition faces upward, FIG. 16 is a perspective view showing the rear side of the dispenser-container of this embodiment, and FIG. 17 is a cross sectional view of the embodiment illustrated in FIGS. 15 and 16, which view is similar to FIG. 4.

This fifth embodiment is similar to the fourth embodiment illustrated in FIG. 4 in the following points. The second sheet 8 is located outside the pillow type bag 1 formed by the first sheet 1. The entire peripheries of the second sheet 8 are securely fixed to the first sheet 1. The containing space formed between the second sheet 8 and the first sheet 1 contains the wet sheet-like fibrous materials 11, and the containing space formed by the first sheet 1 contains dry sheet-like fibrous materials 12.

However, this embodiment differs from the fourth embodiment of the dispenser-container in the points set forth below.

The portion 13 securely fixing the longitudinal edges of the second sheet 8 exits on a surface where the opening 20 for dispensing dry sheet-like fibrous materials 12 is formed in the fourth embodiment illustrated in FIGS. 11 and 12. Contrary to this, in the fifth embodiment, as it is obvious from FIG. 17, the portion 13 securely fixing the longitudinal edges of the second sheet 8 locates on a surface opposite to that where the opening 20 for dispensing dry sheet-like fibrous materials 12 is formed.

Accordingly, should the size of the contained wet sheet-like fibrous materials 11 be the same, the width of the second sheet 8 of the fifth embodiment can be narrower than that for the fourth embodiment.

When the second sheet 8 is disposed outside the bag 1 as described with respect to the fourth and fifth embodiments, the width of the second sheet 8 is not limited by the width of the first sheet 1 and can be appropriately set in accordance with the thickness of the contents 11 to be packed. Accordingly, in some cases, the width of the second sheet 8 may be wider than that of the first sheet 1. Contrary to this, when the second sheet 8 is inside the bag formed by the first sheet 1 as described with respect to the first to third embodiments, it is preferred that the width of the second sheet 8 is at most the width of the first sheet 1.

Contrary to the dispenser-container of the fourth embodiment, in the fifth embodiment of the dispenser-container, the perforated line 21, which will form an opening for dispensing the dry sheet-like fibrous materials 12, is formed in the first sheet 1 at a surface opposite to that provided with the flap 4 (see FIG. 16). The longitudinal edges of the first sheet 1 are sealed together. (See FIG. 17, wherein the sealed portion is indicated by reference numeral 22.) Accordingly, contrary to the fourth embodiment illustrated in FIGS. 11 and 12, the longitudinal edges of the first sheet 1 do not serve as an opening for dispensing the dry sheet-like fibrous materials 12. Upon use, the perforated line 21 formed in the first sheet is torn to form an opening, where the dry sheet-like fibrous materials 12 are dispensed.

The remaining constructions of the fifth embodiment are similar to those in the first embodiment explained with reference to FIGS. 1 to 3.

Figure 18:
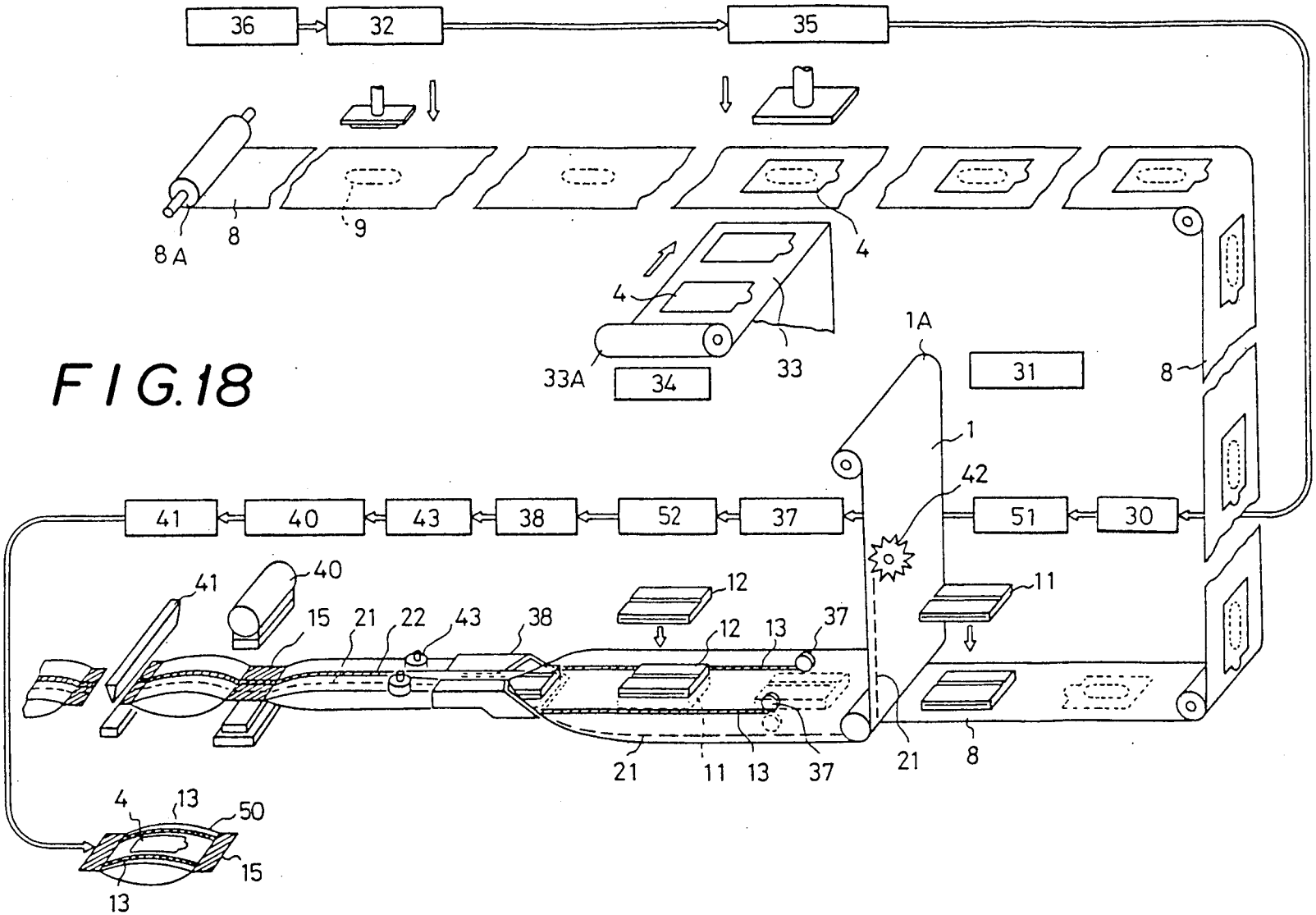
FIG. 18 is a flow diagram showing a process and an apparatus for manufacturing the fifth embodiment of the dispenser-container illustrated in FIGS. 15 to 17.

FIG. 18 illustrates an embodiment of a process and an apparatus for manufacturing the fifth embodiment of the dispenser-container, which are similar to the process and the apparatus illustrated in FIG. 13, except for the following points.

A weakened line 21 is formed near one of the longitudinal edges of the first sheet 1 by means of a perforated line forming device 42.

After the dry sheet-like fibrous materials 12 are wrapped by the first sheet 1, the longitudinal edges of which are overlapped, the overlapped edges are heat sealed by the center heat sealer 43, the sealed portion is indicated by reference numeral 22. Accordingly, contrary to embodiment illustrated in FIGS. 5, the longitudinal edges of the first sheet 1 do not serve as an opening for dispensing the dry sheet-like fibrous materials 12.

The remaining constructions of the fifth embodiment are similar to those in the embodiment explained with reference to FIG. 13.

Figure 19:
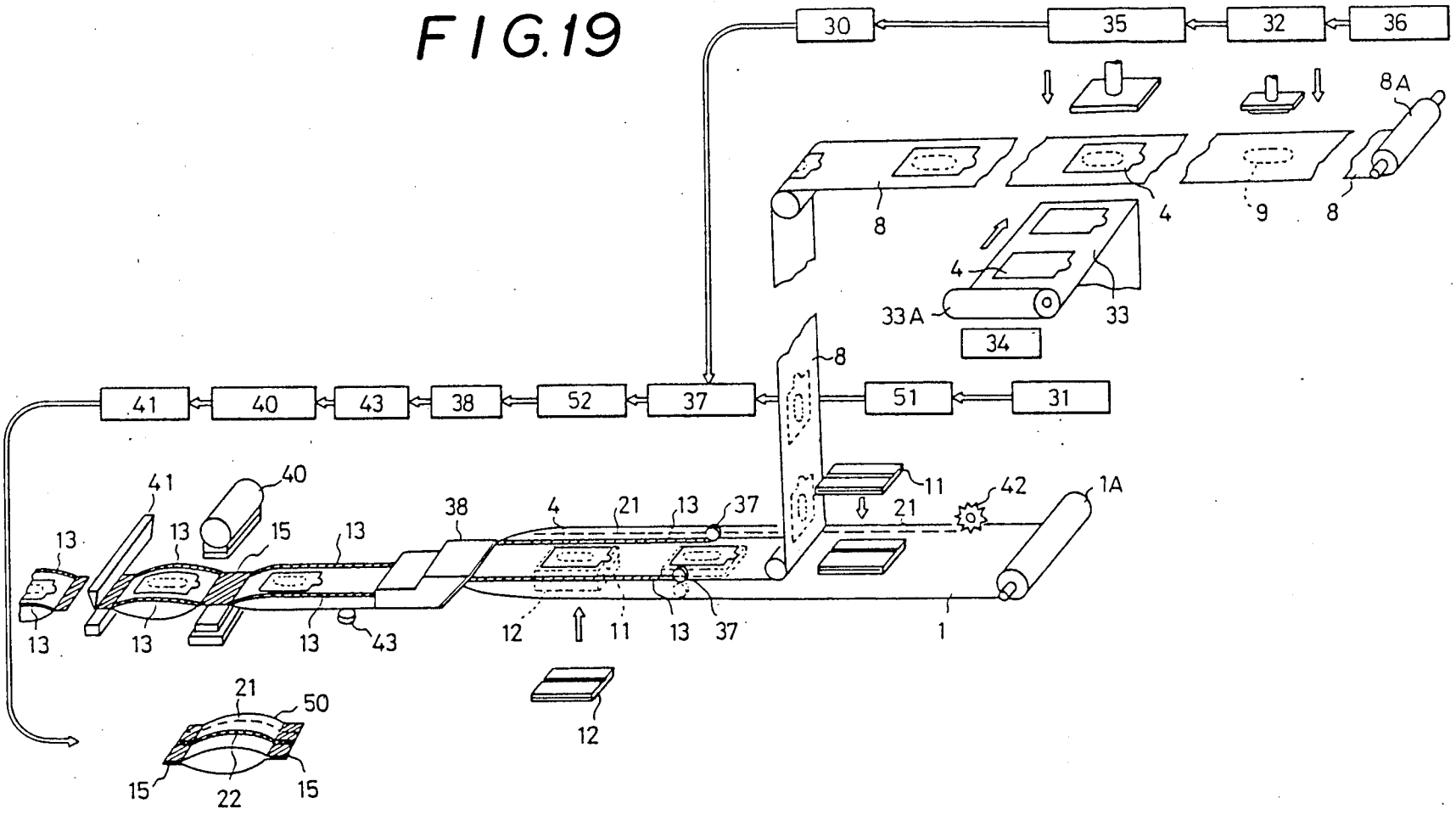
FIG. 19 is a flow diagram showing another process and apparatus for manufacturing the fifth embodiment of the dispenser-container illustrated in FIGS. 15 to 17.

FIG. 19 is a flow diagram showing another process and apparatus for manufacturing the fifth embodiment of the dispenser-container. The process and apparatus as a whole are similar to those explained with reference to FIG. 14 but are different from those explained with reference to FIG. 14 in the following points which are similar to those explained with reference to FIG. 18.

More specifically, a weakened line 21 is formed near one of the longitudinal edges of the first sheet 1 by means of a perforated line forming device 42. After the dry sheet-like fibrous materials 12 are wrapped by the first sheet 1, the longitudinal edges of which are overlapped, the overlapped edges are heat sealed by the center heat sealer 43, the sealed portion is indicated by reference numeral 22.

Although the formation of the perforated line 21 is illustrated to be just after the withdrawal of the first sheet 1 from the roll 1A in FIGS. 18 and 19, the location is not limited to the above-described position as long as it is before the wrapping of the sheet-like fibrous materials 12 by the first sheet 1.

The remaining constructions are similar to those in the embodiment explained with reference to FIG. 14.

ADVANTAGES OF THE INVENTION

The dispenser-container of the present invention containing wet tissues and tissue paper is compact and is convenient for portable use, and in addition, it can be easily handled because it has no hard flange portions, which are often observed in the conventional dispenser-container containing wet tissues and tissue paper. Further, the dispenser-container of the present invention is aesthetic.

The dispenser-container of the present invention is simple in its construction, and it has a construction which is easy to be continuously manufactured at a low manufacturing cost.

In case the second sheet is inside the bag as a partition in the dispenser-container of the present invention, the second sheet can be relatively thin, though the first sheet is necessarily relatively thick because it is required to be liquid impervious, and more preferably, gas impervious. Accordingly, the cost of the sheets can be low. Furthermore, the obtained dispenser-container has an appearance similar to that of a conventionally known pillow type dispenser-container, and it is aesthetic and its shape is familiar to users.

In case the second sheet is outside the bag in the dispenser-container of the present invention, the width of the second sheet 8 is not limited by the width of the first sheet 1, and accordingly, the amount, i.e., the thickness, of the contents in a wet condition contained therein can be increased.

According to the process and the apparatus of the present invention, the dispenser-container of the present invention can be easily and continuously manufactured, and accordingly, the cost for manufacturing the dispenser-container of the present invention can be inexpensive.

Besides, according to the process and the apparatus of the present invention, the step for securely fixing the longitudinal edges of the second sheet and the first sheet can be done easily since the two sheets are fixed before the first sheet is formed in a pillow type bag. Further, if fixing operations and performed by heat sealing, heat can be easily transferred, and the heat sealing operation can be surely done.

What is claimed is:

1. A dispenser-container comprising a container body provided with two containing spaces, one of said containing spaces containing contents in a wet condition and the other of said containing spaces containing contents in a dry condition, wherein:

said container body is a bag comprising a first flexible sheet of a liquid impervious material and a second flexible sheet of a liquid impervious material;

said first sheet comprising a bag of a pillow type, having longitudinal edges which overlap each other and are frangibly sealed with each other to such an extent that they can be separated without tearing said first sheet, whereby an opening for dispensing said contents in a dry condition is formed;

said second sheet having a periphery fixed to said first sheet at the entire periphery thereof and is located at the inside of said bag of the pillow type;

said first sheet having an opening or a weakened line for forming said opening, to permit dispensing of said contents in a wet condition therethrough, at a position on a surface of said container body which surface being opposite to said surface having the overlapping longitudinal edges of said first sheet, and has a flexible flap for resealably covering said opening for dispensing said contents in a wet condition; and said contents in a wet condition are contained in one of said containing spaces formed between said first sheet and said second sheet and provided with said resealable flap.

2. A dispenser-container comprising a container body provided with two containing spaces, one of said containing spaces containing contents in a wet condition and the other of said containing spaces containing contents in a dry condition, wherein:

said container body is a bag comprising a first flexible sheet of a liquid impervious material said first flexible sheet and a second flexible sheet of a liquid impervious material having longitudinal edges which overlap, each other, which overlapping edges are not sealed to each other, whereby an opening for dispensing said contents in dry condition is formed;

said second sheet having a periphery fixed to said first sheet at the entire periphery thereof and is located at the inside of said bag of the pillow type;

said first sheet having an opening or a weakened line for forming said opening, to permit dispensing of said contents in a wet condition therethrough, at a position on a surface of said container body which surface being opposite to said surface having the overlapping longitudinal edges of said first sheet, and has a flexible flap for resealably covering said opening for dispensing said contents in a wet condition; and said contents in a wet condition are contained in one of said containing spaces formed between said first sheet and said second sheet and provided with said resealable flap.

3. A dispenser-container comprising a container body provided with two containing spaces, one of said containing spaces containing contents in a wet condition and the other of said containing spaces containing contents in a dry condition, wherein:

said container body is a bag comprising a first flexible sheet of a liquid impervious material and a second flexible sheet of a liquid impervious material;

said first sheet comprises a bag of a pillow type, having longitudinal edges which overlap each other and are sealed with each other on a surface;

said first sheet having a straight weakened line, for forming an opening for dispensing said contents in a dry condition, formed on a surface having said sealed longitudinal edges, of said pillow type bag;

said second sheet having a periphery fixed to said first sheet over the entire periphery and located at the inside of said bag of a pillow type;

said first sheet having an opening or a weakened line for forming said opening, to permit dispensing of said contents in a wet condition therethrough, at a surface thereof comprising an outer surface of said container body opposite to the surface having the sealed longitudinal edges of said first sheet, and having a flexible flap for resealably covering said opening for dispensing said contents in a wet condition; and said contents in a wet condition are contained in one of said containing spaces formed between said first sheet and said second sheet and provided with said resealable flap.

4. A dispenser-container according to claim 1, 2 or 3 wherein a width of said second sheet is not greater than the width of said first sheet, said second sheet being inside of said bag of a pillow type formed by said first sheet so as to partition an inside space of said pillow type bag into two spaces, said pillow type bag being formed by said first sheet and having an opening or a weakened line for forming said opening, to permit dispensing of said contents in a wet condition therethrough, on a surface of the first sheet opposite to the surface having the overlapping longitudinal edges.

5. A dispenser-container according to claim 6, 7 or 8, wherein said second sheet is fixed to the outside of said bag of the pillow type formed by said first sheet, a portion of said first sheet overlapping with said second sheet partitions an inside space of said bag of said container body into two spaces, and said second sheet having an opening or a weakened line for forming said opening, to permit dispensing of said contents in a wet condition therethrough, formed therein and said flexible flap disposed thereon.

6. A dispenser-container comprising a container body provided with two containing spaces, one of said containing spaces containing contents in a wet condition and the other of said containing spaces containing contents in a dry condition, wherein:

said container body is a bag comprising a first flexible sheet of a liquid impervious material;

said first sheet comprises a bag of a pillow type, having longitudinal edges which overlap each other and are sealed with each other to such an extent that they can be manually separated, whereby an opening for dispensing said contents in a dry condition is formed;

said second sheet having a periphery fixed to said first sheet at the entire periphery thereof and located outside of said bag of the pillow type;

said second sheet having an opening or a weakened line for forming said opening, to permit dispensing of said contents in a wet condition therethrough, at a surface of said container body which surface is opposite to said surface having the overlapping longitudinal edges of said first sheet, and has a flexible flap for resealably covering said opening for dispensing said contents in a wet condition; and said contents in a wet condition are contained in one of said containing spaces formed between said first sheet and said second sheet provided with the resealable flap.

7. A dispenser-container comprising a container body provided with two containing spaces, one of said containing spaces containing contents in a wet condition and the other of said containing spaces containing contents in a dry condition, wherein:

said container body is a bag comprising a first flexible sheet of a liquid impervious material and a second flexible sheet of a liquid impervious material;

said first sheet comprising a bag of a pillow type, having longitudinal edges which overlap each other and are not sealed to each other, whereby an opening for dispensing said contents in a dry condition is formed;

said second sheet, having a periphery fixed to said first sheet at the entire periphery thereof and located outside of said bag of the pillow type;

said second sheet having an opening or a weakened line for forming said opening, to permit dispensing of said contents in a wet condition therethrough, at a position on a surface of said container body which surface is opposite to said surface having the overlapped longitudinal edges of said first sheet, and has a flexible flap for resealably covering said opening for dispensing said contents in a wet condition; and said contents in a wet condition are contained in one of said containing spaces formed between said first sheet and said second sheet and provided with said resealable flap.

8. A dispenser-container comprising a container body provided with two containing spaces, one of said containing spaces containing contents in a wet condition and the other of said containing spaces containing contents in a dry condition, wherein:

said container body is a bag comprising a first flexible sheet of a liquid impervious material and a second flexible sheet of a liquid impervious material;

said first sheet comprises a bag of a pillow type, having longitudinal edges which overlap each other and are sealed to each other;

said first sheet having a straight weakened line, for forming an opening for dispensing said contents in a dry condition, formed on a surface having said sealed longitudinal edges, of said pillow type bag;

said second sheet, having a periphery fixed to said first sheet over the entire periphery and located outside (and inside) of said bag of the pillow type;

said second sheet has one of an opening or a weakened line for forming said opening, to permit dispensing of said contents in a wet condition therethrough, at a surface thereof, comprising an outer surface of said container body opposite to the surface having the overlapping longitudinal edges of said first sheet, and has a flexible flap for resealably covering said opening for dispensing said contents in a wet condition; and said contents in a wet condition are contained in one of said containing spaces formed between said first sheet and said second sheet and provided with said resealable flap.

* * * * *